US006150764A

United States Patent [19]

Hruby et al.

[11] Patent Number: 6,150,764

[45] Date of Patent: Nov. 21, 2000

[54] TANDEM HALL FIELD PLASMA ACCELERATOR

[75] Inventors: Vladimir J. Hruby, Newton; Jeffery M. Monheiser, Randolph; Bruce M. Pote, Sturbridge, all of Mass.

[73] Assignee: Busek Co., Inc., Natick, Mass.

[21] Appl. No.: 09/215,598

[22] Filed: Dec. 17, 1998

[51] Int. Cl.[7] ..... H01J 1/52

[52] U.S. Cl. ..... 315/111.61; 315/111.91; 313/362.1; 60/202

[58] Field of Search ..... 315/111.41, 111.61, 315/111.81, 111.91; 313/231.31, 359.1, 362.1; 60/202

[56] References Cited

U.S. PATENT DOCUMENTS

| | | | |
|---|---|---|---|
| 5,218,271 | 6/1993 | Egorov et al. | 315/111.61 |
| 5,359,258 | 10/1994 | Arkhipov et al. | 313/359.1 |
| 5,475,354 | 12/1995 | Valentian et al. | 315/111.41 X |
| 5,581,155 | 12/1996 | Morozov et al. | 315/111.21 |
| 5,751,113 | 5/1998 | Yashnov et al. | 315/111.21 |
| 5,763,989 | 6/1998 | Kaufman | 313/361.1 X |
| 5,798,602 | 8/1998 | Gopanchuk et al. | 313/359.1 |
| 5,945,781 | 8/1999 | Valentian | 313/362.1 X |

FOREIGN PATENT DOCUMENTS

| | | |
|---|---|---|
| 0 463 408 A2 | 6/1991 | European Pat. Off. . |
| 0 541 309 A1 | 10/1992 | European Pat. Off. . |
| 0541 309 B1 | 10/1992 | European Pat. Off. . |
| 0 778 415 A1 | 12/1996 | European Pat. Off. . |
| 0 800 196 A1 | 12/1996 | European Pat. Off. . |

OTHER PUBLICATIONS

Morozov et al., "Effect of the Magnetic Field on a Closed–Electron–Drift Accelerator";, Soviet Physics–Technical Physics, vol. 17, No. 3, (Sep. 1972).

Khayms et al., l., "Design of a Miniaturized Hall Thruster for Microsatellites", 32nd AIAA/ASME/SAE/ASEE Joint Propulsion Conference, Lake Buena Vista, FL, (Jul. 1–3, 1996).

Morozov et al., "Plasma Accelerator With Closed Electron Drift and Extended Acceleration Zone", Soviet Physics—Technical Physics, vol. 17, No. 1 (1972).

Bugrova et al., "Physical Proceses and Characteristics of Stationary Plasma Thrusters With Closed Electrons Drift", AIDAA/AIAA/DGLR/JSASS 22nd International Electric Propulsion Conference (Oct. 14–17, 1991).

Chubb et al., "Basic Studies of a Low Density Hall Current Ion Accelerator", Third Aerospace Sciences Meeting of the American Institute of Aeronautics and Astronautics, National Aeronautics and Space Administration NY, NY,(Jan. 24–26, 1966).

Manzella et al., "Evaluation of Low Power Hall Thruster Propulsion", American Institute of Aeronautics and Astronautics, Inc. 1996.

Garner et al., "Experimental Evaluation of Russian Anode Layer Thrusters", 30th AIAA/ASME/SAE/ASEE Joint Propulsion Conference, Indianapolis, IN. (Jun. 27–29, 1994).

*Primary Examiner*—Justin P. Bettendorf
*Attorney, Agent, or Firm*—Iandiorio & Teska

[57] ABSTRACT

A tandem Hall field plasma accelerator with closed electron drift includes a magnetic circuit having an inner pole and an outer pole and a magnetic field source and a discharge cavity disposed axially in tandem; the discharge cavity including an axially extending accelerator section defining an exit aperture between the inner and outer poles and a plenum section extending radially outwardly and upstream of the accelerator section and including an anode and a propellant injector. Also disclosed is the use of an electromagnetic coil which provides a magnetic field in a magnetic circuit and includes a multiple turn winding wound on an electrically conductive bobbin. The plasma discharge is connected electrically in series with the electromagnetic coil and a power source with a bobbin defining a single turn secondary coil winding on the magnetic circuit which reduces magnetic field fluctuations in the plasma discharge and reduces eddy currents and consequent heating of the magnetic circuit.

21 Claims, 5 Drawing Sheets

TANDEM HALL FIELD PLASMA ACCELERATOR

FIELD OF INVENTION

This invention relates to a Hall field plasma accelerator, and more particularly to a closed electron drift plasma accelerator in which the discharge cavity has radially large plenum section, short acceleration section and is in tandem with the magnetic field source. The invention also relates to the use of an electromagnetic field source to reduce eddy currents within the magnetic structure and the fluctuations of the magnetic field in the plasma discharge.

BACKGROUND OF INVENTION

There are a number of basic criteria involved in the design and scaling of a hall thruster. The fundamental relationship of the accelerator characteristic length (L) to the ion Larmor Radius ($\rho_i$), the electron Larmor radius ($\rho_e$) and ion-neutral mean free path ($\lambda$) is defined as $$L > \rho_e = \frac{m_e v_e}{qB} \qquad L \ll \rho_i = \frac{m_i v_i}{qB} \qquad L < \lambda \approx \frac{1}{n_n Q_{in}}$$

where m is mass, n is number density, q is elementary charge, v is velocity, B is magnetic field and Q is collision cross-section. Subscripts e, i, n denote electron, ion and neutral respectively.

To maintain constant ($\rho_i$). ($\rho_e$) ($\lambda$) and $v_i$ results in the following scaling relationship.

$$n_n \sim n_i = n_e \sim \frac{1}{L} \qquad I_{dis} = n_i \sigma_i q A \sim \left(\frac{1}{L}\right)(L)^2 \sim L$$

$$B \sim \frac{1}{L} \qquad J_{dis} = I_{dis} \Big/ A \sim \frac{1}{L}$$

$$V_{dis} \sim invariant \Rightarrow E \sim \frac{1}{L} \qquad Power = V_{dis} I_{dis} \sim L$$

These equations relate the thruster characteristic dimension L to plasma parameters and provide the necessary design relationships between the plasma parameters and the thruster geometry. The magnetic circuit is then determined using Gauss and Ampere's law with the final design strongly influenced by structural, thermal and fabrication considerations.

For small thrusters the challenge is to design a magnetic circuit that can handle the required flux while minimizing the increasing dissipation in the electromagnetic coils. As evident from the above scaling relations, the smaller the thruster the stronger the magnetic field, which then requires proportionately more turns on the electromagnet coil leading to higher coil losses through increased Joule dissipation. These small thruster challenges, combined with increasing discharge wall loses (ion and electron collisions with the walls) and increased heat loading stemming from the scaling laws (higher particle, current and power densities), have hampered the development of efficient Hall thruster that operate at nominal power that is less than a few hundred watts. A typical small Hall thruster such as the Russian SPT 50 has an efficiency in the low thirties, Isp in the 1200–1400 sec. range and lifetime of the order of 1000 hours. This performance life is substantially below larger multi KW thrusters.

Conventional Hall thrusters of the SPT and TAL type, regardless of their size, have a magnetic circuit with an inner central stem that guides the magnetic flux into (or out of) the inner pole. To guide the flux without substantial fringing across the plasma gap toward the outer pole (or in the reverse direction) the inner pole diameter is generally larger than the inner stem diameter. This then allows the inner stem, in conventional SPT and TAL type thrusters, to be the core of an inner electromagnetic coil whose outer diameter is smaller than the diameter of the inner pole. As the accelerator size discharge cavity decreases, the inner pole diameter decreases with it, approaching the inner stem diameter, which cannot be reduced as rapidly to accommodate the increasing magnetic field. In the limit, the inner pole and the inner stem have the same diameter with no space for the inner electromagnetic coil. This forces a reconfiguration of the discharge chamber relative to the magnetic circuit.

A common problem with current Hall field plasma accelerators is the fluctuation of the discharge current which may heat up the magnetic circuit by inducing eddy currents within the solid (unsegmented) magnetic material if the discharge is electrically in series with the electromagnetic coil(s). This becomes important in a small thruster with a large magnetic field that may as a consequence have large coil inductance. Also, the discharge current and voltage fluctuations generally require damping using a filter in the power source which increases its complexity, part count, mass and volume.

SUMMARY OF INVENTION

It is therefore an object of this invention to provide an improved Hall field plasma accelerator.

It is a further object of this invention to provide such an improved Hall field plasma accelerator which is efficient and effective even at small scale power and size.

It is a further object of this invention to provide such an improved Hall field plasma accelerator which enables uniform propellant distribution.

It is a further object of this invention to provide such an improved Hall field plasma accelerator which reduces instabilities and increases ionization probability.

It is a further object of this invention to provide such an improved Hall field plasma accelerator which has a short acceleration section length defined as the axial thickness of the outer pole and internal insulation.

It is a further object of this invention to provide such an improved Hall field plasma accelerator which has improved heat rejection, compactness, high performance and long life.

It is a further object of this invention to provide such an improved Hall field plasma accelerator in which the eddy currents and discharge current fluctuation are reduced, simplifying and reducing the size of additional electronic components and filters in the power source.

The invention results from the realization that a more efficient and effective Hall field plasma accelerator, even of small size and power, can be achieved by mounting the magnetic field source and discharge cavity in tandem along the inner pole with the discharge cavity having an axially extending accelerator section defining an exit aperture between the inner and outer poles and a plenum section extending radially outwardly and upstream of the accelerator section and including an anode and propellant injector, and from the further realization that a truly simple and compact filter for damping plasma discharge current fluctuation and reducing eddy currents can be achieved by connecting the electromagnetic field coil in series with the plasma discharge power supply and employing the coil bobbin as a single turn winding on the magnetic circuit.

The invention features a tandem Hall field plasma accelerator with closed electron drift including a magnetic circuit having an inner pole and an outer pole, and a magnetic field source and a discharge cavity disposed axially in tandem. The discharge cavity includes an axially extending accelerator section defining an exit aperture between the inner and outer poles and a plenum section extending radially outwardly and upstream of the accelerator section and including an anode and a propellant injector.

In a preferred embodiment the magnetic field source may be an electromagnetic coil. The inner pole may be the core of the inner coil. The inner pole diameter, the inner stem diameter, and the inner diameter of the coil may be approximately equal. The plenum section may have an outer diameter approximately equal to or larger than the exit aperture outer diameter plus twice the radial dimension of the exit aperture and may have an aspect ratio greater than one. At least a portion of the plenum section may be made of electrically conducting material. The electrically conductive material of the plenum section may form the anode of the accelerator. At least a portion of the plenum section may be made of magnetically conducting material. At least a portion of the plenum section may be made of magnetically and electrically conducting material. At least a portion of the plenum section may also form a propellant manifold with injectors. The manifold with the injectors may be separate and distinct from the plenum section and located within it. The plenum section may be electrically insulated from and in thermal contact with the outer and inner poles. The electromagnetic coil may be wound on an electrically conductive bobbin. The magnetic field source and discharge cavity may be disposed along the inner pole. The magnetic field source may include a permanent magnet. The outer pole may include internal insulation and the axial extent of the outer pole and internal insulation may be less than the radial extent of the exit aperture. The inner pole may include a dielectric insulating layer.

The invention also features a Hall field plasma accelerator with closed electron drift including a power source, a plasma discharge circuit for generating a plasma discharge, and a magnetic circuit including an inner pole and an outer pole. There is an electromagnetic coil for providing a magnetic field in a magnetic circuit; the coil includes a multiple turn winding wound on an electrically conductive bobbin. The plasma discharge may be connected electrically in series with the electromagnetic coil and the power source. The bobbin defines a single turn winding on the magnetic circuit which reduces magnetic field fluctuation in the plasma discharge and reduces eddy currents in and consequent heating of the magnetic circuit.

DISCLOSURE OF PREFERRED EMBODIMENT

Other objects, features and advantages will occur to those skilled in the art from the following description of a preferred embodiment and the accompanying drawings, in which.

Figure 1:
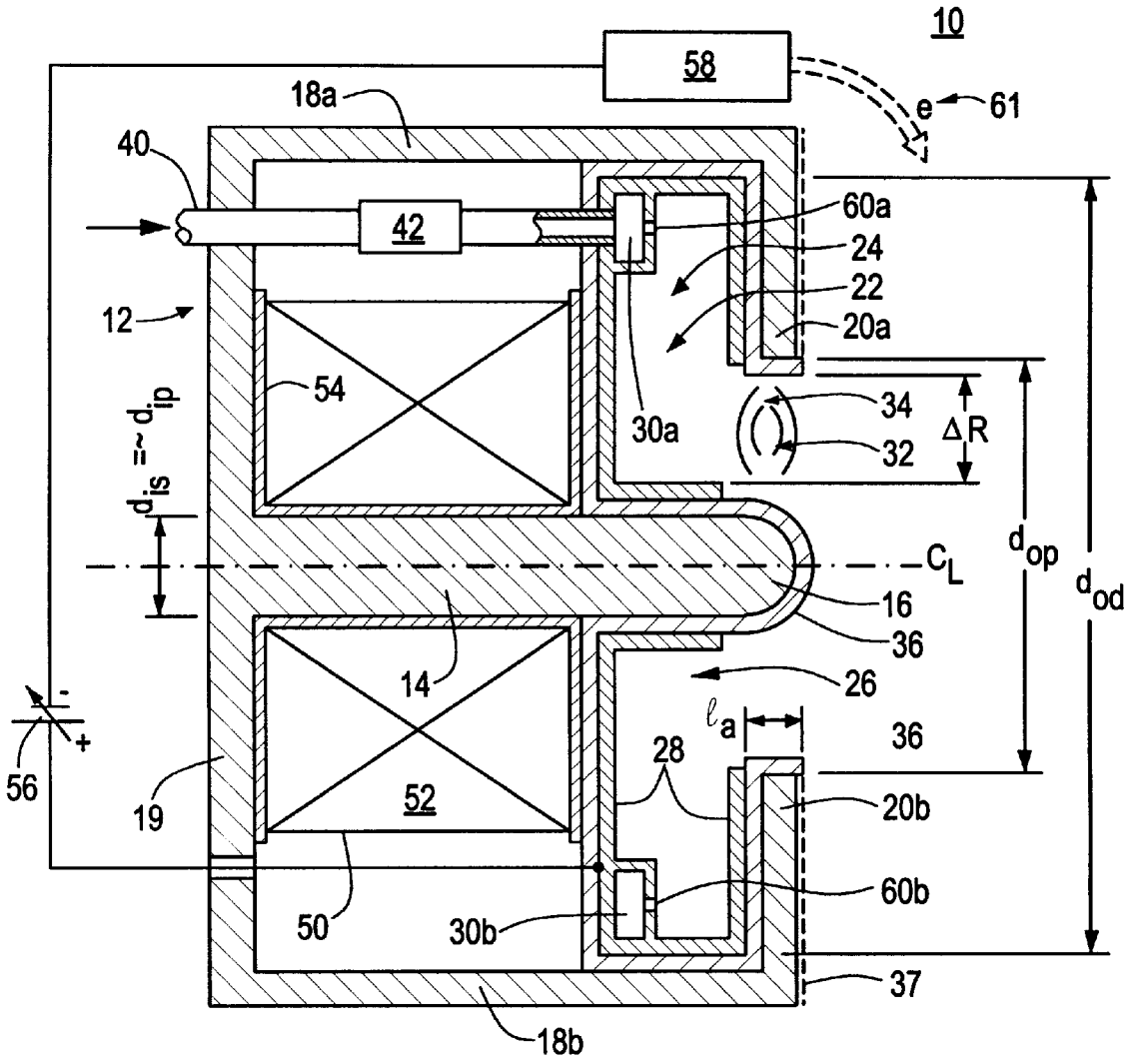
FIG. 1 is an axially symmetric sectional view of the tandem Hall field plasma accelerator according to this invention.

There is shown in FIG. 1 tandem Hall field plasma accelerator with closed electron drift 10 in the form of thruster according to this invention which includes a magnetic circuit structure 12 having a central inner stem 14 which constitutes the inner magnetic pole 16 at its distal end. The magnetic circuit is completed by a back flange 19 and outer shell 18*a* and 18*b* connected to one or more outer poles 20*a*, 20*b*. There is an annular discharge cavity 22 which includes a plenum section 24 where initial ionization occurs and an accelerator section 26 downstream from the plenum section 24. Plenum section 24 may include a wall 28 made of electrically conducting material so that it functions as the anode of accelerator 10. It can also contain a propellant manifold 30, with a number of propellant injectors 60 for providing the propellant gas into plenum 24. Wall 28 may also be made magnetically conductive so that it acts as a magnetic shunt and improves the distribution of magnetic field 32 at exit aperture 34. A dielectric layer 36 may be provided over the inner pole 16 and around outer pole 20*a*, 20*b* to electrically insulate electrically conductive wall/anode 28 from the magnetic circuit 12. However, dielectric layer 36 is preferably made of a good thermal conductor in order to dissipate the heat. Propellant is provided through one or more propellant conduits 40 by way of an electrical insulator, propellant isolator 42, to electrically separate the anode/wall 28 from ground.

Upstream from discharge cavity 22 there is located a magnetic field source 50 for providing the magnetic field 32 at exit aperture 34 in accelerator section 26. Magnetic field source 50 is an electromagnet including a coil 52 which in this particular case is mounted on a metal or electrically conductive bobbin 54 which acts as a single turn winding on magnetic circuit 12 for purposes explained hereinafter. If the purpose achieved by this is not necessary then the conductive bobbin may be eliminated. A permanent magnet may be used as a magnetic field source, to augment and/or eliminate the coil 52. In such case the permanent magnet is inserted in any convenient part of the magnetic circuit 12.

Anode 28 may be energized through any conventional DC power source including a battery 56 in series with the cathode 58 which provides electrons 61 that move through exit aperture 34 in magnetic field 32 and accelerator section 26 and through the plenum section 24 to the anode 28.

Some of the more prominent features of accelerator 10 include a single magnetic field source, electromagnetic coil 52, located upstream of the discharge cavity 22 instead of surrounding it and being surrounded by it as in some conventional designs. It also features a discharge cavity 22 with two distinct sections defined by the larger outer diameter plenum section 24 followed by a smaller diameter accelerator section 26 between the inner 16 and outer 20*a*, 20*b*, magnetic poles. The magnetic field source 50 and the discharge cavity 22 are axially consecutive or in tandem. Within discharge cavity 22 the plenum section 24 and accelerator section 26 are also axially consecutive or in tandem. This tandem arrangement permits the outer diameter $d_{od}$ of discharge cavity 22 to be much larger than the diameter $d_{od}$ of the outer poles 20*a*, 20*b*. This is contrasted with some conventional designs where the discharge cavity outer diameter is always smaller than the outer pole diameter. This feature has some very important and desirable consequences: propellant is injected at a large radius achieving excellent uniformity as it moves through plenum section 24 before entering the intense discharge near or at the exit aperture 34. The large plenum section 24 forms a propellant reservoir reducing instabilities and increasing probability of ionization. The acceleration section length, $l_a$, is approximately equal to the distance from the outer pole 20*a*, 20*b* exterior surface to the inner surface of the plenum section 24 which includes a vacuum gap or a solid insulator 36, is very short relative to the conventional design and is much smaller than the radial extent, ΔR, of the exit aperture 32. The discharge cavity 22 can be mounted directly on the dielectric layer 36 against the upstream side of the outer poles 20*a*, 20*b*, providing a large thermal contact area achieving improved heat rejection and compact packaging. All of these items contribute to high performance and long life.

Typically the discharge cavity plenum section outside diameter is approximately equal to or larger than the exit aperture outer diameter plus twice the radial dimension of the exit aperture. This can be expressed as:

$$\text{Plenum}_{O.D.} \geqq d_{op} + 2\Delta R$$

where $d_{op}$ and ΔR are defined in FIG. 1. The plenum section has an aspect ratio greater than one. Aspect ratio is here defined as the radial dimension of the plenum section, which is equal to half its outside diameter minus half its inner diameter, divided by its axial dimension. The propellant injection manifold 30 which is located in the plenum section 24 is fed by one or more propellant conduits 40 which include a propellant isolator 42 so that the conduits 40 outside of the thruster body may be at the thruster body potential. Propellant is injected into the plenum section 24 typically through a set of choked orifices 60*a*, 60*b* in the axial or radial or tangential direction at a diameter greater than the outer diameter of the exit aperture to maximize the propellant residence time and increase probability of ionization which is also aided by the large volume of the plenum section 24 which serves as a propellant reservoir enhancing discharge stability.

When metal wall 28 functions as an anode, it ensures near zero internal electric field and its large surface ensures low anode voltage drop by reducing anode current density. As indicated previously, wall 28 may be made of material which also has high magnetic permeability. This insures that the interior of the cavity will be free of magnetic field which reduces induced electric fields and anode voltage drops. The magnetic material shunts a portion of the magnetic flux around the cavity from the inner pole 16 to the outer 20*a*, 20*b* pole and forms a region of steeply rising radial magnetic field 32 near the exit aperture 34. This enhances the thruster performance and life.

The presence of dielectric layer 36 prevents electrical shorts between the anode wall 28 and the thruster body such as magnetic circuit 12. The dielectric material, such as boron nitride (BN) also covers the entire inner pole as shown. Although the inner pole has a hemispherical exterior surface, this is not a necessary limitation of the invention. A conical cover over the inner pole 16 instead of hemisphere cover 36 is one successful alternative. The dielectric layer 36 reduces heating of the inner magnetic pole 16 and ensures that magnetic field lines leading from or to the inner pole 16 are not at the same electric potential. As is well known, magnetized plasma has a very high electric conductivity in the direction parallel to magnetic field (B) lines but low conductivity in the perpendicular direction. Therefore, B field lines which intersect an equipotential surface, e.g., exposed metal of the inner pole 16 of a small thruster (where as a consequence of the scaling laws the magnetic field is very high) may be forced to substantially the same potential. This reduces the electric field perpendicular to the B field lines which is the ion acceleration electric field, and hence reduces the thruster performance. For these reasons the outer pole face may also be coated with a dielectric layer, e.g., plasma sprayed or solid layer 37 as required.

When magnetic field source 50 is an electromagnetic coil 52, it may be powered using: (1) an independent power source; (2) a discharge power source 56, connected in series with a second, separate power source which is connected to the electromagnetic coil 52; and (3) discharge power source, 56, in series with the electromagnetic coil 52 the anode 28 and the cathode 58. This circuit results in the simplest power processing unit. The discharge power supply is self regulating during starting due to coupling between the applied magnetic field and the resistance of the plasma discharge which amounts to automatic positive feedback. This is also very useful during normal operation, preventing possible large oscillations from extinguishing the discharge. The second approach utilizes an extra power supply in series with the power source 56 to trim the magnetic field, when desirable to maintain good performance over the accelerator life time when changes of the magnetic structure 12 or the dielectric surfaces occur. The first approach allows complete independence of the electromagnet from the discharge.

One consequence of the second and third approaches, which are otherwise very desirable, is that the fluctuating plasma discharge current may heat up the magnetic circuit 12 by inducing eddy currents within the solid magnetic material of circuit 12. This becomes especially important in small thrusters with a large magnetic field that require large coil inductance. To reduce these effects the electromagnet coil 52 may be wound on an electrically conductive bobbin 54, FIG. 1, made of low resistivity material such as aluminum or copper. This forms in effect a solid core transformer: that is, no laminations as in conventional transformers, with the coil forming the primary winding and the bobbin forming a single turn secondary winding. The induced currents then circulate within the bobbin 54, reducing fluctuations of the magnetic field B 32 in the plasma and reducing heating of the magnetic circuit 12 material. An additional benefit of this approach is that the electromagnet 52 with a conductive bobbin constitutes a portion of the power source output filter when it is connected in series with the anode and cathode in combination with the other electrical components that reduce the discharge current and voltage fluctuations. In the absence of this approach a larger filter must be included in the power source, thereby increasing its complexity, part count, mass and volume.

Figure 2:
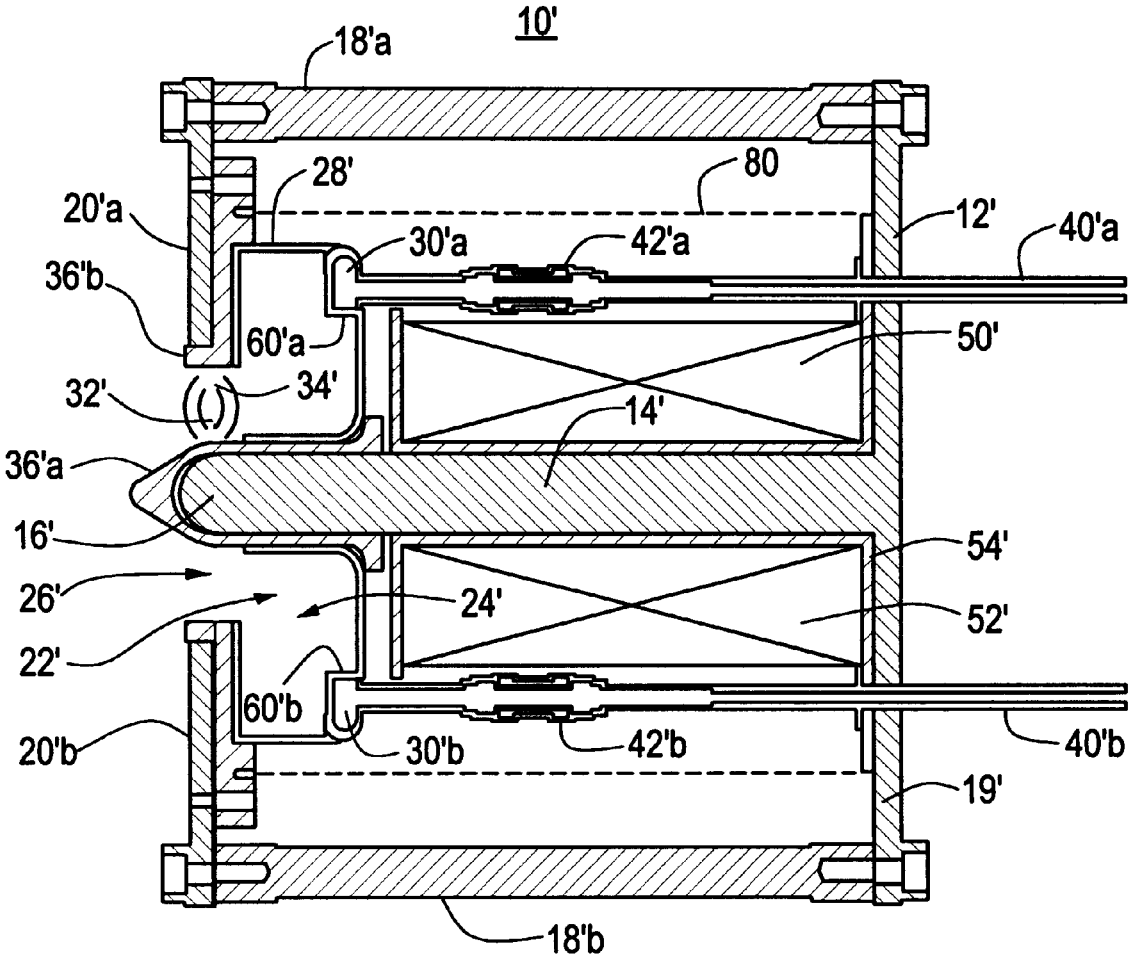
FIG. 2 is a view similar to FIG. 1 of another construction of the Hall field plasma accelerator of this invention.
Figure 3:
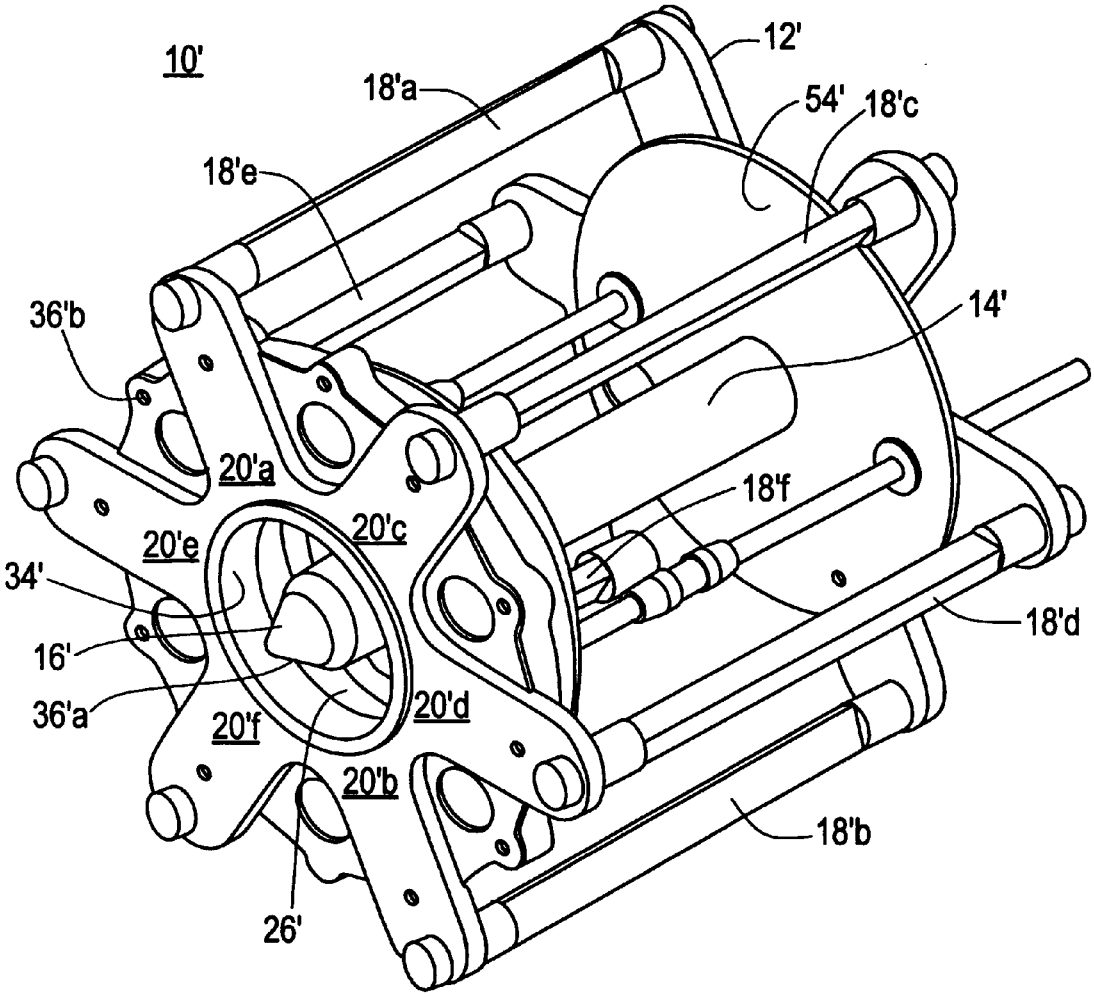
FIG. 3 is a three-dimensional view of the accelerator of FIG. 2 without the electromagnetic field coil and electron screen.
Figure 4:
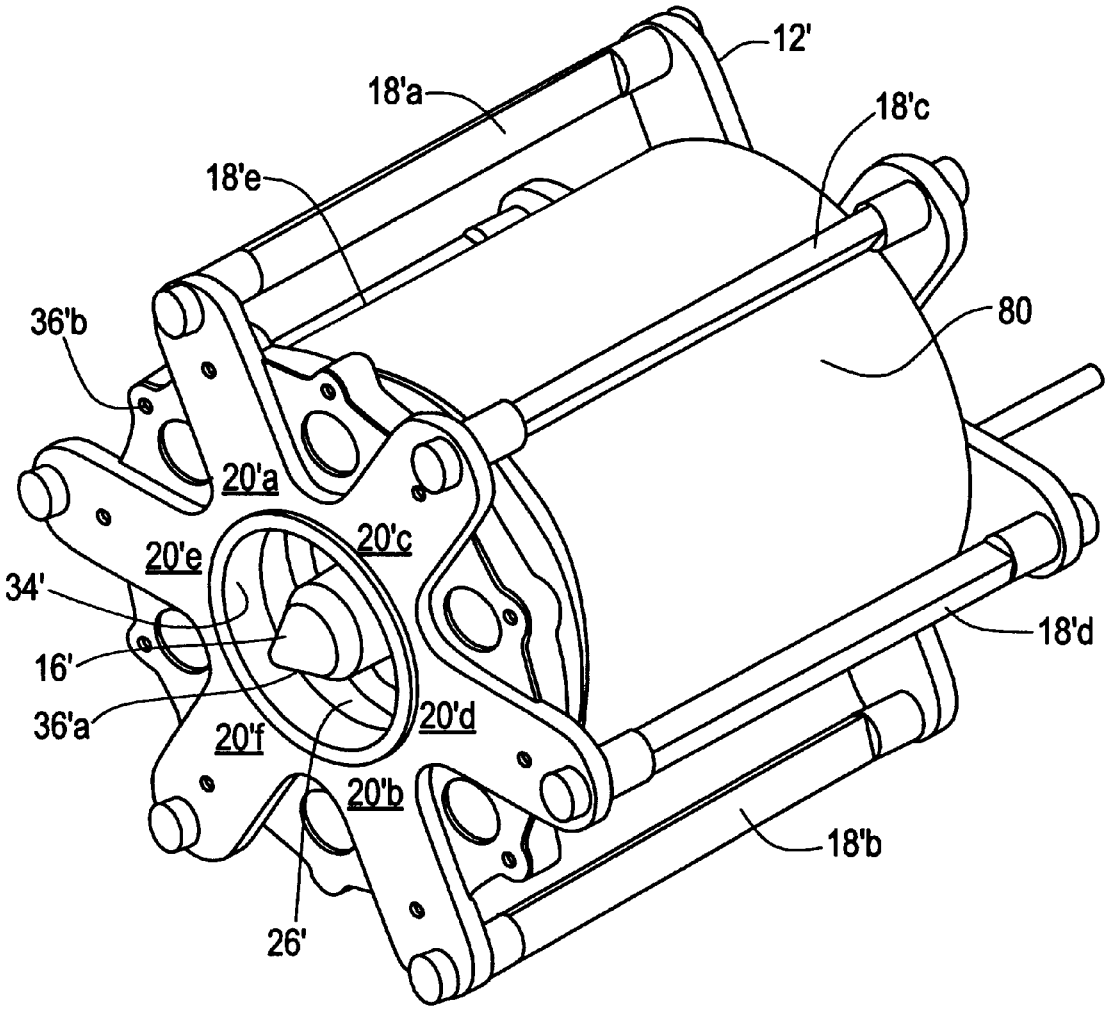
FIG. 4 is a three-dimensional view of the accelerator of FIG. 3 with the electromagnetic field coil and electron screen in place.

In one of several possible constructions, shown in FIG. 2, the magnetic field circuit 12' is made in separate pieces and bolted together as shown, and the insulating dielectric layer 36 is formed in two parts 36'*a* and 36'*b* and the magnetic circuit has six magnetic conduits referred to as ribs 18'*a–f*, which are more understandable when FIG. 3 is referenced in conjunction with FIG. 2. In FIG. 4 electromagnetic coil 52' is absent from bobbin 54' for illustrative purposes. An electron screen 80, FIG. 2, may be installed as shown more clearly in FIG. 4. Electron screen 80, FIGS. 2 and 4, prevents electrons from reaching the exterior of the discharge chamber. Electron screen 80 has a maximum possible open area fraction and a hole size smaller than the local Debye length. The high open area fraction prevents pressure differential across the screen and allows radiative heat rejection from the discharge cavity and the electromagnetic coil.

In FIGS. 3 and 4 magnetic circuit 12 uses six high permeability ribs 18'*a–f* that connect the outer poles 20*a–f* and the back portion of magnetic field circuit 12. These ribs 18'*a–f* also provide structural rigidity without interfering with the radiative heat rejection. Magnetic material has been removed from the outer poles and the back flange 19 of the magnetic circuit 12 to minimize weight and the inner pole 16 has a cone shape which promotes long life.

Figure 5:
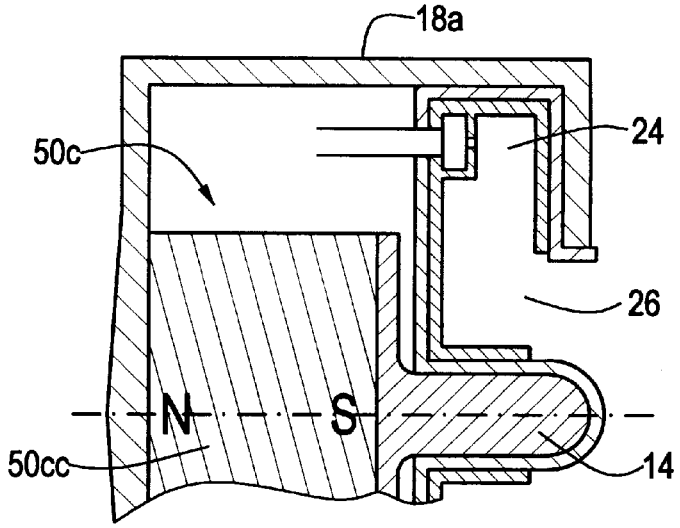
FIGS. 5, 6 and 7 are schematic designs showing alternate tandem locations of the magnetic field source be it a permanent magnet or electromagnet.
Figure 6:
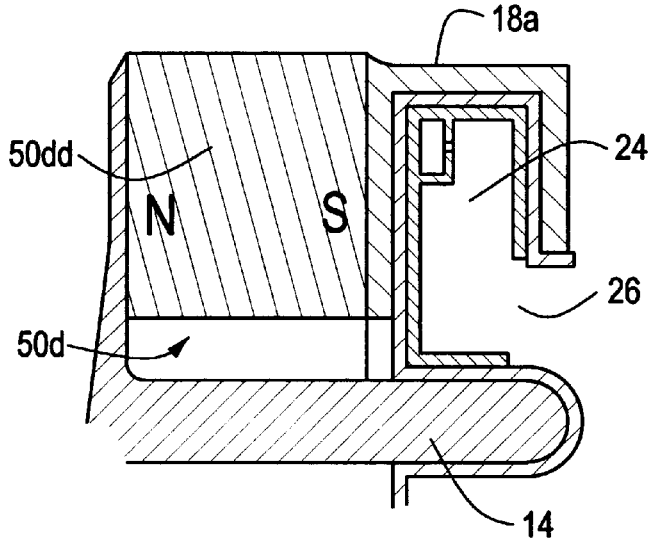
Figure 7:
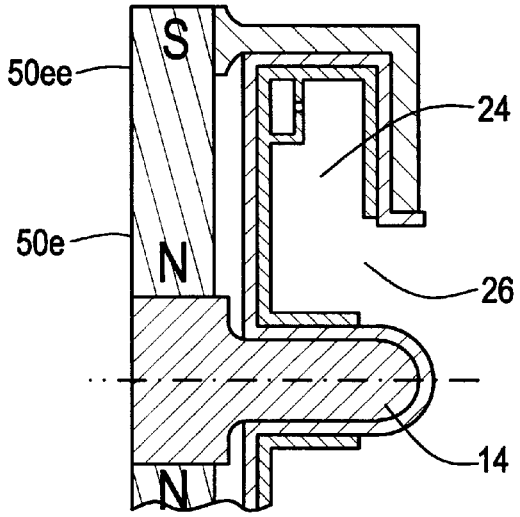

Although the magnetic field source is shown as an electromagnetic coil mounted along the inner pole, neither limitation is required. The magnetic field source can be a permanent magnet and the magnetic field source may be located anywhere in tandem with the discharge cavity. For example, in FIG. 5, the magnetic field source 50*c* may include a cylindrical permanent magnet 50*cc* mounted on stem 14 or the magnetic field source 50*d*, FIG. 6, may include a tubular permanent magnet 50*dd* attached to or in place of ribs 18*a*, 18*b*, or, as shown in FIG. 7, the magnetic field source 50*e* may be a permanent magnet 50*ee* replacing the magnetic back flange 19. In each case, FIGS. 5, 6 and 7, the permanent magnet may be replaced by an electromagnetic coil with appropriately arranged magnetic core. Also in each case the magnetic field source, be it a permanent magnet or electromagnet, or a combination of the two, is in tandem with the discharge cavity. Although the geometry of the discharge cavity 22 is circularly annular, it is not a necessary feature of this invention, as other shapes, such as a racetrack geometry, can be utilized.

Although specific features of this invention are shown in some drawings and not others, this is for convenience only as each feature may be combined with any or all of the other features in accordance with the invention.

Other embodiments will occur to those skilled in the art and are within the following claims.

What is claimed is:

1. A tandem Hall field plasma accelerator with closed electron drift comprising:

a magnetic circuit having an inner pole and an outer pole;

a magnetic field source and a discharge cavity disposed axially consecutive in tandem, said discharge cavity including an axially extending accelerator section defining an exit aperture between said inner and outer poles and a plenum section extending radially outwardly and upstream of said accelerator section and including an anode and a propellant injector.

2. The tandem Hall field accelerator of claim 1 in which said magnetic field source is an electromagnetic coil.

3. The tandem Hall field accelerator of claim 2 in which said inner pole is the core of said electromagnetic coil.

4. The tandem Hall field accelerator of claim 2 in which said coil is mounted on an electrically conductive bobbin.

5. The tandem Hall field accelerator of claim 1 in which said inner pole diameter and the inner diameter of said coil are approximately equal.

6. The tandem Hall field accelerator of claim 1 in which said plenum section has an outer diameter approximately equal to or larger than the exit aperture outer diameter plus twice the radial dimension of the exit aperture and has an aspect ratio greater than one.

7. The tandem Hall field accelerator of claim 1 in which the distance from the outer pole exterior surface to the interior of the said plenum section is much less than the radial extent of the exit aperture.

8. The tandem Hall field accelerator of claim 1 in which at least a portion of said plenum section is made of electrically conducting material.

9. The tandem Hall field accelerator of claim 8 in which said electrically conductive material of the said plenum section forms the anode of the accelerator.

10. The tandem Hall field accelerator of claim 1 in which at least a portion of said plenum section is made of magnetically conducting material.

11. The tandem Hall field accelerator of claim 1 in which at least a portion of said plenum section is made of magnetically and electrically conducting material.

12. The tandem Hall field accelerator of claim 1 in which at least a portion of said plenum section also forms a propellant manifold with injectors.

13. The tandem Hall field accelerator of claim 12 in which said manifold with said injector is separate and distinct from said plenum section and located within it.

14. The tandem Hall field accelerator of claim 1 in which said plenum section is electrically insulated from and in thermal contact with said outer and inner poles.

15. The tandem Hall field accelerator of claim 1 in which said magnetic field source is a permanent magnet or a combination of permanent magnet and an electromagnet.

16. The tandem Hall field accelerator of claim 1 in which said magnetic field source and discharge cavity are disposed along said inner pole.

17. The tandem Hall field accelerator of claim 1 in which said inner pole includes a dielectric insulating layer.

18. The tandem Hall field accelerator of claim 1 in which said outer pole includes a dielectric insulating layer.

19. A Hall field plasma accelerator with closed electron drift comprising:

a power source;

a plasma discharge circuit for generating a plasma discharge;

a magnetic circuit including an inner pole and an outer pole;

an electromagnetic coil for providing a magnetic field in said magnetic circuit; said coil including a multiple turn winding wound on an electrically conductive bobbin; and said plasma discharge circuit being connected with said electromagnetic coil and said power source; said bobbin defining a single coil winding on the magnetic circuit which reduces magnetic field fluctuation in the plasma discharge circuit and reduces eddy currents and consequent heating of the magnetic circuit.

20. A tandem Hall field plasma accelerator with closed electron drift comprising:

a magnetic circuit having an inner pole and an outer pole;

a magnetic field source and a discharge cavity disposed axially in tandem;

said discharge cavity including an axially extending accelerator section defining an exit aperture between said inner and outer poles and a plenum section made of magnetically conducting material extending radially outwardly and upstream of said accelerator section and including an anode and a propellant injector.

21. A tandem Hall field plasma accelerator with closed electron drift comprising:

a magnetic circuit having an inner pole and an outer pole;

a magnetic field source and a discharge cavity disposed axially in tandem;

said discharge cavity including an axially extending accelerator section defining an exit aperture between said inner and outer poles and a plenum section made of magnetically and electrically conducting material extending radially outwardly and upstream of said accelerator section and including an anode and a propellant injector.

* * * * *